US012152455B2

(12) United States Patent
Gonzalez et al.

(10) Patent No.: US 12,152,455 B2
(45) **Date of Patent: *Nov. 26, 2024**

(54) DOUBLE GRIP RETENTION FOR WELLBORE INSTALLATIONS

(71) Applicant: Cameron International Corporation, Houston, TX (US)

(72) Inventors: Juan Carlos Gonzalez, Houston, TX (US); Brandon Blake Shirley, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/327,960

(22) Filed: Jun. 2, 2023

(65) Prior Publication Data

US 2023/0304371 A1 Sep. 28, 2023

Related U.S. Application Data

(63) Continuation of application No. 17/390,332, filed on Jul. 30, 2021, now Pat. No. 11,702,900.

(60) Provisional application No. 62/706,087, filed on Jul. 31, 2020.

(51) Int. Cl.
*E21B 33/04* (2006.01)
*E21B 33/05* (2006.01)

(52) U.S. Cl.
CPC ..... *E21B 33/0422* (2013.01); *E21B 33/05* (2013.01)

(58) Field of Classification Search
CPC ..... E21B 33/0422; E21B 33/05; E21B 33/04
See application file for complete search history.

(56) References Cited

U.S. PATENT DOCUMENTS

| | | | |
|---|---|---|---|
| 4,794,988 | A | 1/1989 | van Bilderbeek |
| 4,856,592 | A | 8/1989 | Van Bilderbeek et al. |
| 4,938,289 | A | 7/1990 | Van Bilderbeek |
| 5,026,200 | A | 6/1991 | van Bilderbeek |
| 6,092,596 | A | 7/2000 | Van Bilderbeek |
| 6,095,243 | A | 8/2000 | Van Bilderbeek et al. |
| 6,571,877 | B1 | 6/2003 | Van Bilderbeek |
| 6,595,297 | B2 | 7/2003 | Dallas |
| 6,662,868 | B1 | 12/2003 | Van Bilderbeek |
| 6,938,696 | B2 | 9/2005 | Dallas |

(Continued)

FOREIGN PATENT DOCUMENTS

WO 2021074633 A1 4/2021

*Primary Examiner* — Taras P Bemko
(74) *Attorney, Agent, or Firm* — Matthew Goode

(57) ABSTRACT

A wellhead assembly with a gripping device for securing multiple components of the wellhead assembly is provided. In one embodiment, a system includes a wellhead housing mounted above a hollow body, such that an axial bore extends through the wellhead housing and the hollow body, and a wellhead hanger positioned within the axial bore. The system also includes a clamp that provides a first grip that secures the wellhead housing to the hollow body and a second grip that secures the wellhead hanger within the axial bore. The second grip includes elastic deformation, via the clamp, of at least one of the wellhead housing or the hollow body into tight engagement with an exterior of the wellhead hanger to secure the wellhead hanger at the location within the axial bore. Additional systems, devices, and methods are also disclosed.

14 Claims, 7 Drawing Sheets

(56) References Cited

U.S. PATENT DOCUMENTS

| | | | |
|---|---|---|---|
| 7,104,318 | B2 | 9/2006 | Hendrie |
| 7,111,688 | B2 | 9/2006 | vanBilderbeek |
| 7,128,143 | B2 | 10/2006 | Van Bilderbeek |
| 7,344,162 | B2 | 3/2008 | Van Bilderbeek |
| 7,648,176 | B2 | 1/2010 | Van Bilderbeek |
| 7,740,061 | B2 | 6/2010 | Van Bilderbeek et al. |
| 9,145,752 | B2 | 9/2015 | Hendrie |
| 9,273,532 | B2 | 3/2016 | Hendrie et al. |
| 9,388,656 | B2 | 7/2016 | Hendrie et al. |
| 10,287,838 | B2 | 5/2019 | Van Bilderbeek et al. |
| 10,400,511 | B2 | 9/2019 | Netecke et al. |
| 11,053,769 | B2 | 7/2021 | Craycraft |
| 2005/0139360 | A1* | 6/2005 | Van Bilderbeek .. E21B 33/0422 166/208 |
| 2015/0204147 | A1* | 7/2015 | Netecke ..... E21B 3/02 166/85.4 |
| 2016/0222748 | A1* | 8/2016 | Van Bilderbeek ..... E21B 23/04 |
| 2017/0016301 | A1 | 1/2017 | Nguyen |
| 2020/0284116 | A1 | 9/2020 | Greska |
| 2022/0034189 | A1 | 2/2022 | Hendrie |
| 2022/0034196 | A1 | 2/2022 | Shirley et al. |

* cited by examiner

DOUBLE GRIP RETENTION FOR WELLBORE INSTALLATIONS

CROSS-REFERENCE TO RELATED APPLICATIONS

This patent application is a continuation of U.S. Pat. No. 11,702,900, filed on 30 Jul. 2021, which claims the benefit of U.S. Provisional Patent Application Ser. No. 62/706,087, filed on Jul. 31, 2020. Each of the above applications is incorporated herein by reference in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space. Wells can also include tubing strings that facilitate flow of fluids through the wells. Hangers can be attached to the casing and tubing strings and received within wellheads to enable these tubular strings to be suspended in the wells from the hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Certain embodiments of the present disclosure generally relate to wellhead assemblies and hangers for suspending tubular strings in wells. In some embodiments, a wellhead assembly includes a wellhead housing connected to some other hollow body such that an axial bore extends through the wellhead housing and the other hollow body. The wellhead housing may be casing head, and the other hollow body may be a casing string, a landing mandrel, or another wellhead housing, for example. A clamp or other gripping device applies an inward compression force that securely connects the wellhead housing to the other hollow body. The inward compression force also elastically deforms the wellhead housing or other hollow body into tight, gripping engagement with a wellhead hanger inside the axial bore to allow suspension of a tubular string in a well from the gripped hanger. In some instances, the strength of the grip on the gripped hanger enables the gripped hanger to suspend casing loads from above by transferring all loads on an upper shoulder of the gripped hanger down to the grip.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
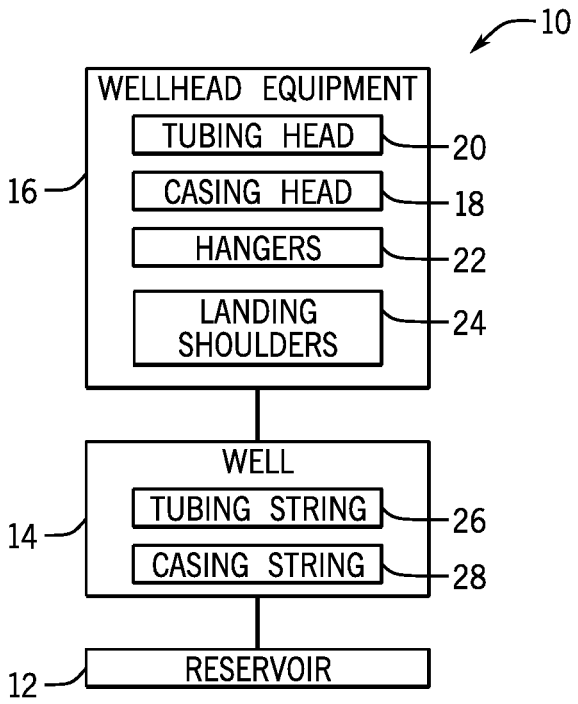
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14, such as an onshore well. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. In some instances, and as discussed in greater detail below, a wellhead hanger 22 can be secured within a hollow wellhead body using a gripping device without landing the wellhead hanger 22 on a landing shoulder 24. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

Figure 2:
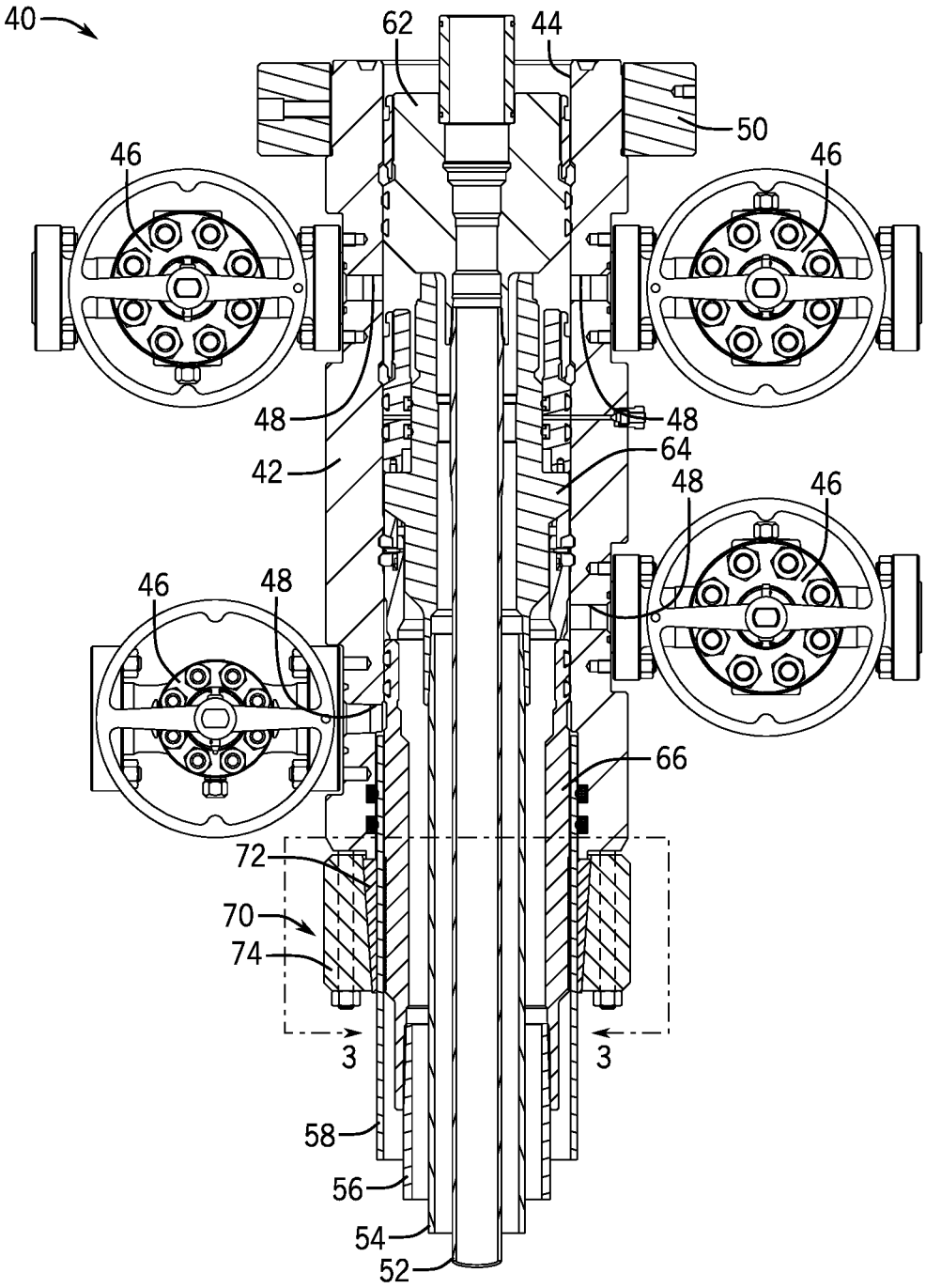
FIG. 2 depicts a wellhead assembly having a clamp that connects a wellhead housing to a casing string and also elastically deforms the casing string to securely hold a wellhead hanger in accordance with one embodiment.

One example of a wellhead assembly 40 is generally depicted in FIG. 2. The assembly 40 includes a pressure-containing outer body, shown in FIG. 2 as including a hollow wellhead housing 42 with an axial bore 44. Although shown as a casing head in FIG. 2, the hollow wellhead housing 42 may be provided as a different pressure-containing outer body in other embodiments. Valves 46 are coupled to the wellhead housing 42 to control flow into and out of the axial bore 44 through ports 48. The wellhead assembly 40 can include one or more flanges 50 to facilitate connection to other components. An example of such a flange 50 is shown in FIG. 2 as a removable flange 50 threaded onto the top of the wellhead housing 42, but other flanges may also or instead be used (e.g., at the bottom of the housing 42). The flanges 50 can be removable from or integral with the wellhead housing 42.

Various tubular strings can extend downwardly from the wellhead housing 42 into the well. In FIG. 2, these tubular strings include a tubing string 52 and casing strings 54, 56, and 58. These tubular strings can have any suitable diameters, but in one embodiment the tubing string 52 has a two-and-one-eighth-inch diameter, the casing string 54 has a five-and-one-half-inch diameter, the casing string 56 has an eight-and-five-eighths-inch diameter, and the casing string 58 has an eleven-and-three-quarter-inch diameter. A tubing hanger 62, a casing hanger 64, and a casing hanger 66 are installed in the bore 44. The tubing string 52 is suspended from the tubing hanger 62, the casing string 54 is suspended from the casing hanger 64, and the casing string 56 is suspended from the casing hanger 66. These wellhead hangers are depicted as mandrel-style hangers threaded onto tubular strings in FIG. 2, but may take other forms, such as slip-style hangers. It will be appreciated that the casing hangers 64 and 66 can include flow-by slots or ports to facilitate fluid communication through the bore 44 between the well 14 and the ports 48, and that various packoffs, seals, and shoulders may also be included in the bore 44.

As depicted in FIG. 2, an upper end of the casing string 58 receives a lower end of the wellhead housing 42. The casing string 58 is coaxial with the wellhead housing 42 and generally continues the axial bore 44 downward from the wellhead housing 42. A gripping device securely connects the wellhead housing 42 to the casing string 58. By way of example, the gripping device is shown in FIG. 2 as a clamp 70 having a compression ring 72 in a collar or bowl 74. The clamp 70 in FIG. 2 is positioned below the wellhead housing 42 and is radially outward of and surrounds the casing string 58 and the casing hanger 66. This clamp 70 applies an inwardly directed compression force to grip both the casing string 58 (to securely connect the wellhead housing 42 to the casing string 58) and the casing hanger 66 (to securely hold the casing hanger 66 within the bore).

The compression ring 72 can have any suitable form. In some embodiments, the ring 72 is an annular ring with a split in its circumference (i.e., a C-ring) to facilitate contraction of the ring 72 about the casing string 58 when compressed by the bowl 74. In some other embodiments, the ring 72 is a segmented ring having multiple pieces (e.g., two to six pieces), which may be circumferentially arranged about the casing string 58 within the bowl 74 in a manner similar to slips.

Figure 3:
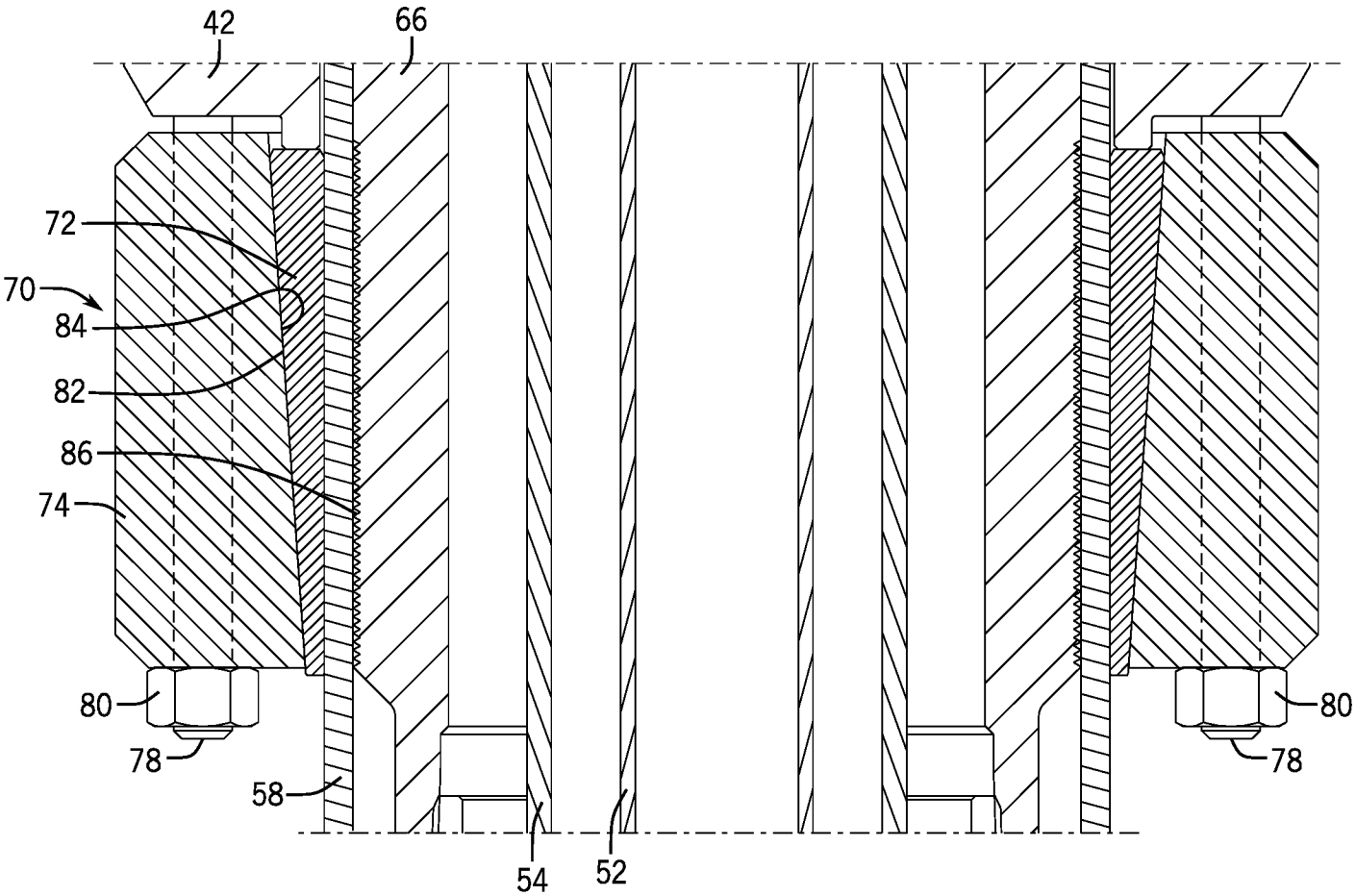
FIG. 3 is a detail view of the clamp of FIG. 2 in accordance with one embodiment.

As shown in further detail in FIG. 3, the clamp 70 is fastened to and suspended from the lower end of the wellhead housing 42 with fasteners. In this depicted embodiment the bowl 74 is fastened to the wellhead housing 42 with studs 78 and nuts 80, but other fasteners, such as bolts, may also or instead be used. Although only two studs 78 and nuts 80 are depicted in FIG. 2, it will be appreciated that the clamp 70 can include any suitable number of studs 78 and nuts 80, such as twelve or sixteen pairs of circumferentially arrayed studs 78 and nuts 80 fastening the bowl 74 to the wellhead housing 42.

Radial compressive forces may result from the tightening of nuts 80 (or bolts) to drive the bowl 74 upward along an incline or deflecting surface. More specifically, as the bowl 74 is driven upward toward wellhead housing 42 during tightening of the clamp 70 by a first amount, a tapered inner surface 84 of the bowl 74 moves along a mating tapered outer surface 82 of the compression ring 72. This mating engagement of the surfaces 82 and 84 pushes the compression ring 72 inwardly, which applies a radially inward compression force against an exterior of the casing string 58 to secure the wellhead housing 42 to the casing string 58 via the clamp 70.

Further tightening of the clamp 70 causes the clamp 70 to apply an increased radially inward compression force on the casing string 58 to elastically deform the casing string 58 inward to securely grip the casing hanger 66. That is, the casing string 58 may be elastically deformed to grip the casing hanger 66 within the inner diameter of the casing string 58. The casing hanger 66 may have a toothed outer surface 86, such as shown in FIG. 3, to facilitate gripping by the elastically deformed casing string 58. In at least some embodiments, the casing hanger 66 is not landed on a shoulder in the wellhead assembly 40 and the grip of the casing hanger 66 by the casing string 58 (provided by the clamp 70) is sufficient to fully support the casing load suspended from the hanger 66.

Figure 4:
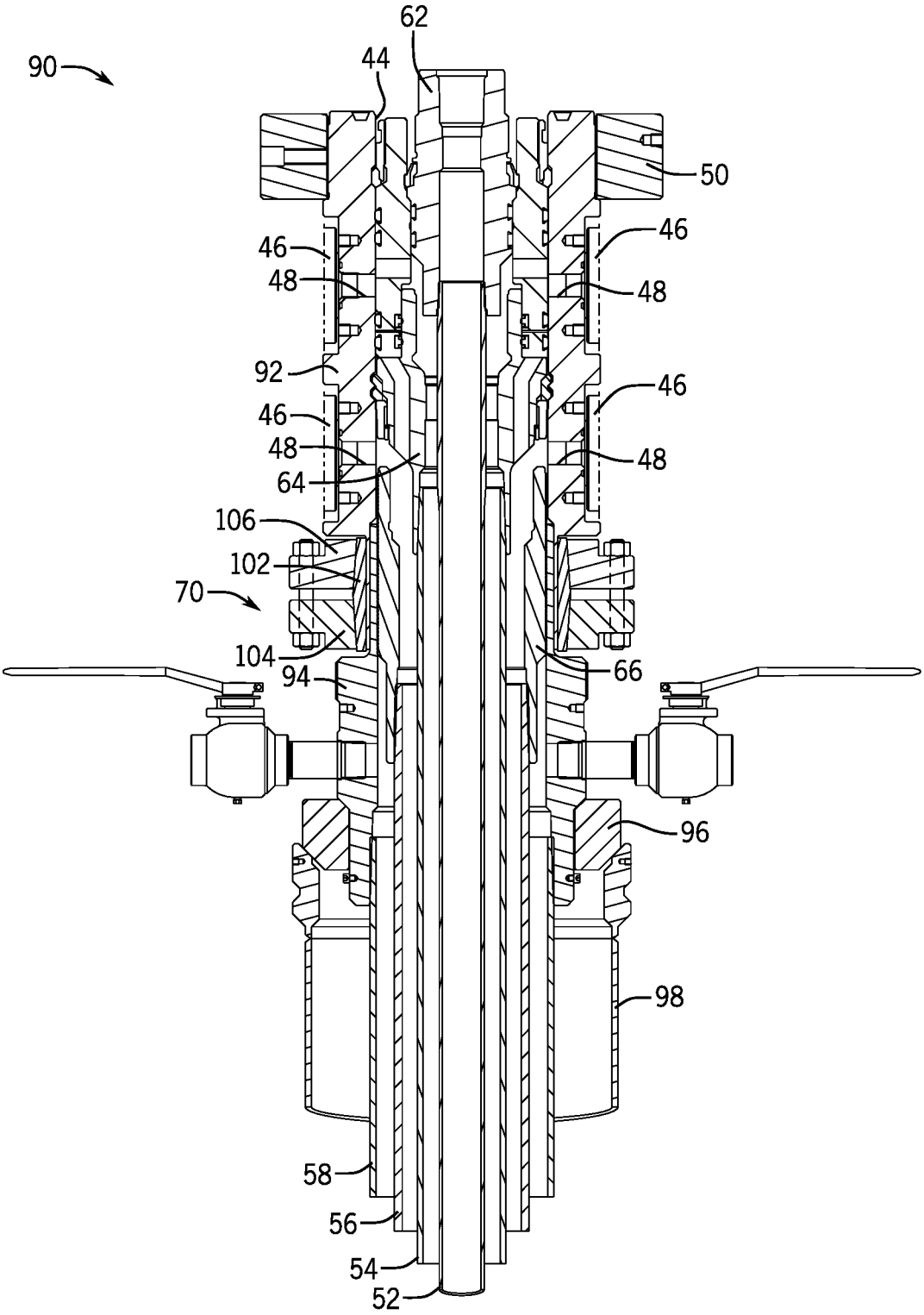
FIG. 4 depicts a wellhead assembly having a clamp that connects a wellhead housing to a landing mandrel and elastically deforms the landing mandrel to securely hold a wellhead hanger in accordance with one embodiment.

Rather than connecting a wellhead housing body directly to a casing string, a clamp 70 or other gripping device can be used to connect a wellhead housing body to another hollow body, such as to a landing mandrel or another wellhead housing body. By way of example, a wellhead assembly 90 is depicted in FIG. 4 as having a pressure-containing body that includes a wellhead housing (i.e., casing head 92) and a landing mandrel 94, which is supported by an annular shoulder 96 above a conductor casing 98. In this embodiment, a clamp 70 grips the exterior of the pressure-containing body and, via elastic deformation, securely connects the casing head 92 to the landing mandrel 94 and also holds the casing hanger 66 within the bore 44.

Figure 5:
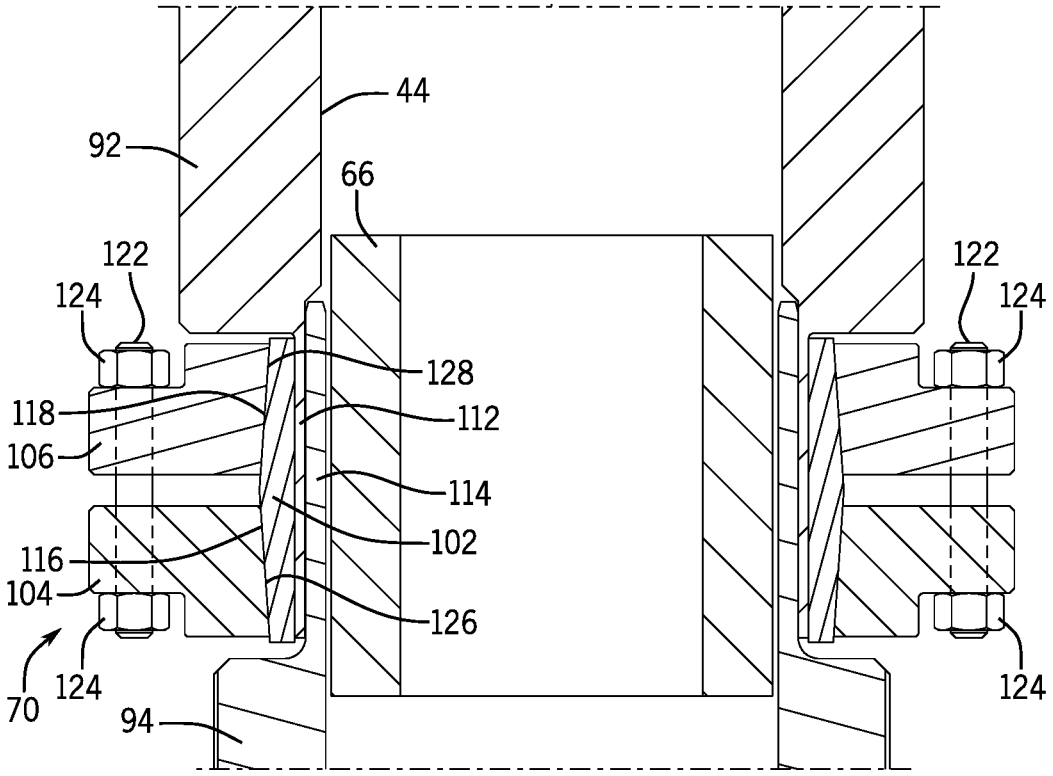
FIG. 5 generally depicts a portion of the wellhead assembly of FIG. 4 at which the clamp encircles the wellhead hanger and radially overlapping portions of the wellhead housing and landing mandrel in accordance with one embodiment.

As shown in FIG. 4, the clamp 70 includes a compression ring 102 and actuating collars 104 and 106. Like noted above with respect to compression ring 72, the compression ring 102 may be a split ring or a segmented ring or may take any other suitable form. The clamp 70 surrounds radially overlapping portions of the casing head 92 and the landing mandrel 94, as well as the casing hanger 66. That is, the casing hanger 66, the radially overlapping portions of the casing head 92 and landing mandrel 94, and the clamp 70 are concentrically arranged at an axial location along the bore 44. This concentric arrangement may be seen in additional detail in FIG. 5. In this example, the casing head 92 includes a lower end with a neck 112 that is received by a neck 114 of an upper end of the landing mandrel 94. The casing hanger 66 (generically depicted in FIG. 5 for simplicity) is positioned in the bore 44 inside of these overlapping necks 112 and 114, which are encircled by the clamp 70. In FIG. 5, the neck 112 of the casing head 92 is radially outward of and surrounds the neck 114 of the landing mandrel 94. In other instances, such as shown in FIG. 6, the neck 114 of the landing mandrel 94 may instead be the outer neck, surrounding the neck 112 of the casing head 92.

The clamp 70 is installed on the casing head 92 or the landing mandrel 94 before the casing head 92 is positioned on the landing mandrel 94 in at least some cases. In FIGS. 4-6, the clamp 70 is shown as a dual-acting clamp in which the compression ring 102 has non-parallel tapered outer surfaces 116 and 118 and is held within the collars 104 and 106, which are fastened together with studs 122 and nuts 124 (e.g., twelve or sixteen studs arranged in a bolt circle and extending axially through the collars 104 and 106, with nuts 124 threaded on the ends of the studs 122). Other fasteners (e.g., bolts) may also or instead be used. In this arrangement, the clamp 70 is dual-acting in that tightening of the nuts 124 (or bolts, if used) induces movement along two different inclines as collars 104 and 106 are brought together. More specifically, tightening of the nuts 124 causes inner tapered surfaces 126 and 128 of the collars 104 and 106 to ride up the outer surfaces 116 and 118, pushing the compression ring 102 radially inward against the neck 112 (FIG. 5) or neck 114 (FIG. 6). This radial compression force connects the casing head 92 and the landing mandrel 94 by elastically deforming the outer neck (i.e., neck 112 in FIG. 5 or neck 114 in FIG. 6) inwardly to securely grip the inner neck (i.e., neck 114 in FIG. 5 or neck 112 in FIG. 6). In at least some instances, and as generally shown in FIG. 4, further tightening of the clamp 70 (e.g., by tightening nuts 124) applies additional radial compressive force sufficient to elastically deform the inner neck and securely grip the hanger 66.

Figure 6:
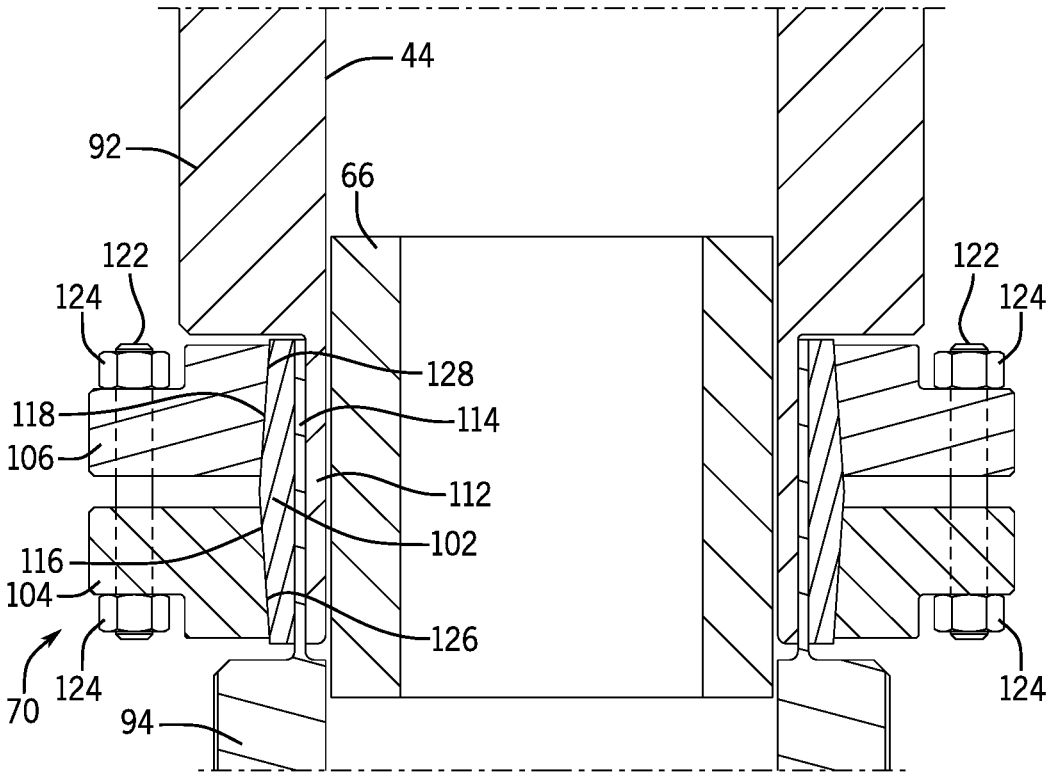
FIG. 6 generally depicts a different arrangement of the radially overlapping portions of the wellhead housing and landing mandrel of FIG. 4 in accordance with one embodiment.
Figure 7:
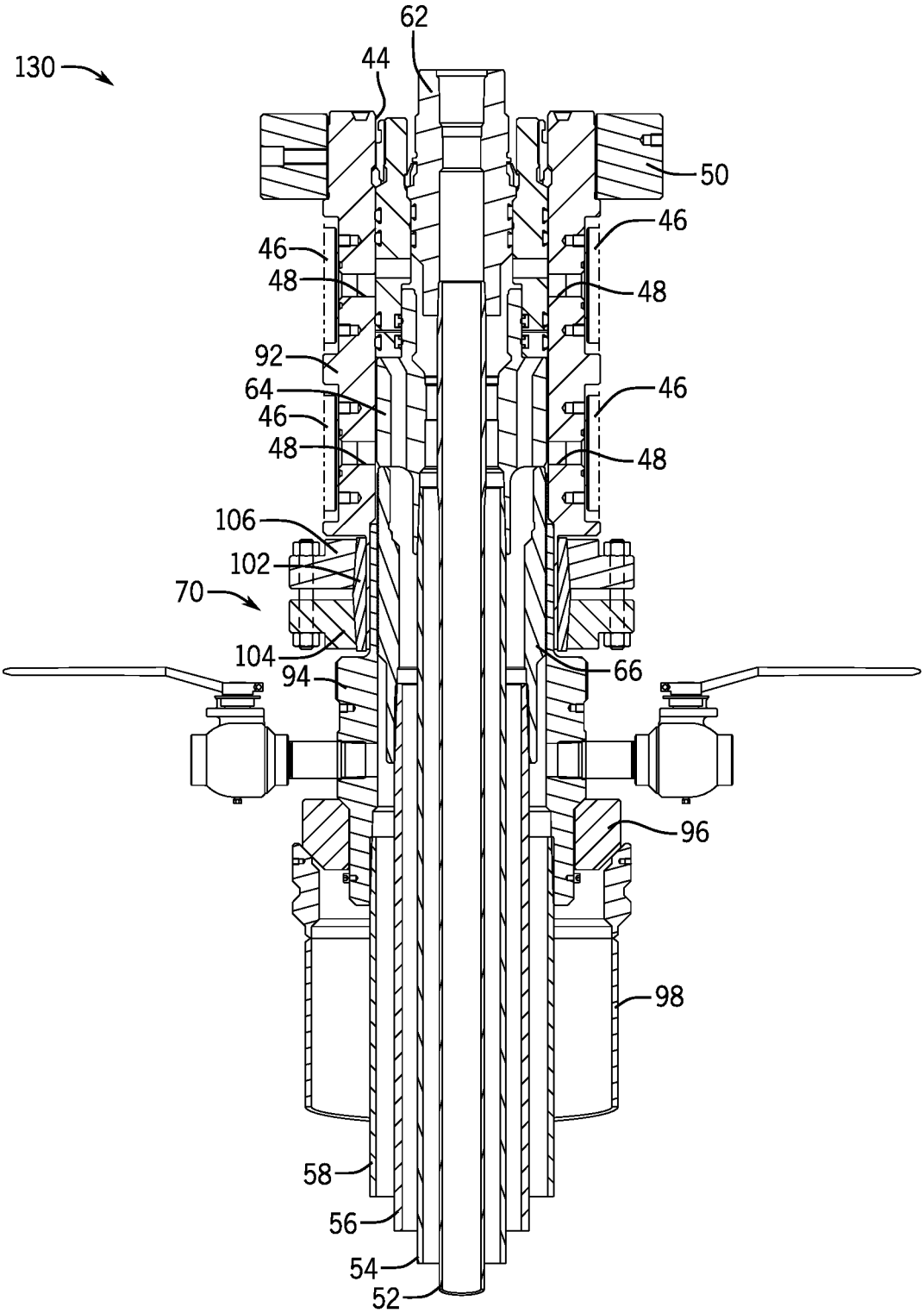
FIG. 7 depicts a wellhead assembly like that of FIG. 4 but in which the wellhead hanger held through elastic deformation of the landing mandrel supports additional casing loads from other wellhead hangers positioned above in accordance with one embodiment.

In some embodiments, such as those of FIGS. 4-6, the casing hanger 66 is not landed on a shoulder and the casing hanger 66 and its attached casing load may be fully supported by the elastic deformation of the inner neck, induced by the clamp 70, against the casing hanger 66. Still further, in some instances the grip provided by the clamp 70 on the casing hanger 66 via elastic deformation of a radially interposed body (e.g., the casing string 58 of FIG. 2, or the inner neck of either the casing head 92 or landing mandrel 94 of FIGS. 4-6) is strong enough to provide sufficient load capacity on the top shoulder of the casing hanger 66 to suspend additional loads (e.g., casing loads) from above. An example of this is generally depicted in the wellhead assembly 130 of FIG. 7. This wellhead assembly 130 is like the wellhead assembly 90 but, rather than the casing hanger 64 being supported by a lock ring engaged with the side wall of the bore 44 for support (as in FIG. 4), the casing hanger 64 in FIG. 7 is landed on and supported by the casing hanger 66. The casing load from the casing hanger 64 bearing on an upper end of the casing hanger 66 is transferred down to and may be fully supported by the clamp-induced grip on the casing hanger 66. Similarly, this grip on the casing hanger 66 may also fully support the load of the tubing hanger 62 (and its tubing string 52), which is landed in a packoff supported by the casing hanger 64 in FIG. 7.

From the description above, it will be appreciated that the clamp 70 may be actuated to provide both a first grip that secures a wellhead housing (e.g., wellhead housing 42 or casing head 92) to a hollow body (e.g., casing string 58, landing mandrel 94, or another wellhead housing) and also a second grip that secures a wellhead hanger (e.g., casing hanger 66) at a location within an axial bore of a wellhead assembly. In at least some instances, the first and second grips are engaged at different stages of a wellhead installation process. For example, in some cases the first grip is engaged to secure the wellhead housing to a hollow body before running a wellhead hanger into the wellhead assembly. Once the wellhead housing is secured to the hollow body, the wellhead hanger may be run into the wellhead assembly and the second grip may then be engaged to secure that wellhead hanger within the bore. The first grip may be engaged, for example, by tightening the clamp 70 by a first amount that is enough to secure the wellhead housing to the hollow body but not so much as to engage the second grip and interfere with running of the wellhead hanger into the bore. After the wellhead hanger is run into position, the second grip may then be engaged by further tightening the clamp 70 by a second amount. In some cases, one or more additional wellhead hangers may be landed in the wellhead assembly such that they are supported by the wellhead hanger that is securely held with the second grip.

Although a single-acting clamp 70 is shown in FIG. 2 and a dual-acting clamp 70 is shown in FIGS. 4 and 7, these may be reversed—a dual-acting clamp could be used with the wellhead assembly 40 of FIG. 2 and a single-acting clamp 70 could be used with the wellhead assemblies 90 and 130 of FIGS. 4 and 7. Still further, while these clamps 70 are depicted as examples of gripping devices, other clamps or gripping assemblies may also or instead be used in other embodiments. For instance, clamps 70 could be electrically or hydraulically actuated, or any other suitable technique or device may be used to provide the first and second grips and elastic deformation described above.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a wellhead having a pressure-containing body with an axial bore;

a wellhead hanger positioned within the axial bore;

an additional wellhead hanger positioned within the axial bore; and a clamp positioned along an exterior of the pressure-containing body and radially outward of the wellhead hanger, the clamp including a compression ring positioned outside of the pressure-containing body, wherein the clamp applies a compressive force that elastically deforms the pressure-containing body so as to both securely grip the wellhead hanger within the axial bore with a clamp-induced grip and support the additional wellhead hanger within the axial bore via the wellhead hanger and the clamp-induced grip.

2. The system of claim 1, wherein the additional wellhead hanger is a casing hanger.

3. The system of claim 1, wherein the pressure-containing body includes a first hollow body and a second hollow body.

4. The system of claim 3, wherein the first hollow body includes a casing head and the second hollow body includes a landing mandrel.

5. The system of claim 1, wherein the clamp includes two actuating rings.

6. The system of claim 1, wherein the clamp is a dual-acting clamp.

7. A method of installing a wellhead assembly, the method comprising:

positioning a first wellhead hanger in an axial bore of a wellhead housing body;

tightening a clamp positioned along an exterior of the wellhead housing body, wherein the clamp includes a compression ring positioned outside of the wellhead housing body, and tightening the clamp includes tightening the clamp such that the clamp applies a radially inward force that elastically deforms the wellhead housing body and causes the wellhead housing body to securely grip the first wellhead hanger with a clamp-induced grip; and landing a second wellhead hanger within the axial bore such that a casing load of the second wellhead hanger is supported by the clamp-induced grip on the first wellhead hanger.

8. The method of claim 7, wherein landing the second wellhead hanger within the axial bore includes landing the second wellhead hanger on the first wellhead hanger.

9. The method of claim 7, comprising landing a third wellhead hanger within the axial bore.

10. The method of claim 9, wherein landing the third wellhead hanger within the axial bore includes landing the third wellhead hanger within the axial bore such that a tubing load of the third wellhead hanger is supported by the clamp-induced grip on the first wellhead hanger.

11. The method of claim 9, wherein landing the third wellhead hanger within the axial bore includes landing the third wellhead hanger in a packoff supported by the second casing hanger within the axial bore.

12. The method of claim 7, wherein the wellhead housing body is coupled to a conductor casing.

13. The method of claim 12, wherein the wellhead housing body is coupled to the conductor casing via a landing mandrel.

14. The method of claim 7, wherein positioning the wellhead hanger in the axial bore includes running the wellhead hanger into the axial bore without landing the wellhead hanger on a shoulder in the axial bore.

* * * * *